US008596080B2

(12) United States Patent
Wolfe, IV et al.

(10) Patent No.: US 8,596,080 B2
(45) Date of Patent: Dec. 3, 2013

(54) AIR CONDITIONING SYSTEM HAVING AN IMPROVED INTERNAL HEAT EXCHANGER

(75) Inventors: Edward Wolfe, IV, E. Amherst, NY (US); Prasad Shripad Kadle, Williamsville, NY (US); James Alan Bright, Gasport, NY (US); Mingyu Wang, Amherst, NY (US)

(73) Assignee: Delphi Technologies, Inc., Troy, MI (US)

( * ) Notice: Subject to any disclaimer, the term of this patent is extended or adjusted under 35 U.S.C. 154(b) by 624 days.

(21) Appl. No.: 12/788,377

(22) Filed: May 27, 2010

(65) Prior Publication Data

US 2011/0289959 A1 Dec. 1, 2011

(51) Int. Cl.

| | |
|---|---|
| ***F25B 41/04*** | (2006.01) |
| ***F25B 41/00*** | (2006.01) |
| ***F25B 43/02*** | (2006.01) |

(52) U.S. Cl.

USPC ..... 62/217; 62/513; 62/468

(58) Field of Classification Search

USPC ..... 251/12, 73, 336, 349; 137/517, 853, 137/860; 62/83, 84, 113, 513, 468, 217; 210/97

See application file for complete search history.

(56) References Cited

U.S. PATENT DOCUMENTS

| | | | | |
|---|---|---|---|---|
| 2,165,741 | A * | 7/1939 | Wolfert | 62/196.3 |
| 2,512,694 | A * | 6/1950 | Stout et al. | 137/107 |
| 2,799,999 | A * | 7/1957 | Swanson | 62/503 |
| 4,026,122 | A * | 5/1977 | Kuhn et al. | 62/196.3 |
| 5,265,415 | A * | 11/1993 | Cox, Jr. | 60/258 |
| 5,761,926 | A * | 6/1998 | Luis | 62/513 |
| 6,327,868 | B1 * | 12/2001 | Furuya et al. | 62/197 |
| 6,899,126 | B2 * | 5/2005 | Weigand et al. | 137/512.15 |
| 7,251,948 | B2 * | 8/2007 | Hyun et al. | 62/196.1 |
| 7,444,995 | B2 * | 11/2008 | Burke et al. | 123/516 |
| 7,645,125 | B2 | 1/2010 | Dewispelaere et al. | |
| 2007/0130988 | A1 * | 6/2007 | Matsumoto et al. | 62/512 |
| 2010/0018246 | A1 | 1/2010 | Wolfe, IV et al. | |

FOREIGN PATENT DOCUMENTS

WO 2010/051333 5/2010

OTHER PUBLICATIONS

SAE Technical Paper Series; 2007-01-1523: Double-pipe Internal Heat Exchanger for Efficiency Improvement in Front Automotive Air Conditioning System; Shun Kurata, Takahisa Suzuki and Kenji Orgura.

* cited by examiner

*Primary Examiner* — Frantz Jules
*Assistant Examiner* — Cassey D Bauer
(74) *Attorney, Agent, or Firm* — James M. Chan

(57) ABSTRACT

An air conditioning system having an improved internal heat exchanger (IHX) assembly. The IHX assembly includes an elongated cavity for low pressure refrigerant flow from an evaporator and an interior tube disposed within the cavity for high pressure refrigerant flow from a condenser, and a pressure equalization passage between the low and high pressure sides. The passage is large enough to allow pressures to equalize between the condenser and evaporator while the air conditioning system is inactive, so as to prevent the pressure differential that would otherwise enable the loss of refrigerant oil from the compressor, and small enough not to effect the operation of the air conditioning system. The pressure equalization passage may be a by-pass valve assembly having a reed portion that is normally open when the air conditioning system is inactive and closed when the air conditioning system is active for maximum cooling efficiency.

10 Claims, 4 Drawing Sheets

AIR CONDITIONING SYSTEM HAVING AN IMPROVED INTERNAL HEAT EXCHANGER

TECHNICAL FIELD OF INVENTION

The invention relates to an automotive air conditioning system having an improved internal heat exchanger; more particularly, to an internal heat exchanger having a passive by-pass valve between high pressure side and low pressure side for preventing oil migration throughout the air conditioning system during periods of inactivity.

BACKGROUND OF THE INVENTION

An automotive air conditioning system typically includes a condenser mounted in proximity to the front grill, a refrigerant compressor located within the engine compartment, and an evaporator contained in an HVAC housing that is essentially inside the passenger compartment. Internal heat exchangers (IHX), such as the double pipe IHX disclosed in SAE Publication No. 2007-01-1523 and the internal coiled tube IHX disclosed in U.S. patent application Ser. No. 12/487,709 are used to take advantage of the temperature differential between the refrigerant low pressure side and the refrigerant high pressure side to improve the overall cooling capacity of the air conditioning system.

The main inner volume of the compressor, the so called crankcase, is substantially hollow, but numerous moving components are either contained in or exposed to it, such as the central drive shaft and associated support bearings, swash plate, and reciprocating pistons. During operation, the compressor pumps refrigerant through the air conditioning system. The refrigerant carries entrained lubricant oil, also known as refrigerant oil to those of ordinary skill in the art, which reaches and lubricates the various moving part interfaces within the air conditioning system including the moving components within the compressor. When the compressor sits for extended periods of non-operation, it is desirable that a substantial pool of lubricant oil remain at the bottom of the crankcase to be available to lubricate the interfaces during start up.

Observations made prior to the subject invention found that lubricant oil appeared to be actively leaving the compressor crankcase during periods of vehicle and compressor inactivity and settling within the condenser and evaporator, where it would not be immediately available at compressor start up. This phenomenon of lubricant oil migration was found to be caused by a pressure imbalance between the main crankcase volume of the compressor and other components of the air conditioning system. This imbalance was creating a condition by which liquid refrigerant oil, which is miscible in the refrigerant, was subject to a combination of internal siphoning and pushing forces that pushed and pulled the liquid out of the compressor.

U.S. patent application Ser. No. 10/874,046 provides a partial solution to the undesired migration of lubricant oil migration that includes a small pressure equalization passage provided at a high point within the compressor, between the crankcase and suction chamber in the manifold. This reduces the tendency of the liquid refrigerant-oil mixture to be pulled and or pushed out of the crankcase and into the manifold, and ultimately to the condenser. However, this solution does not adequately address the migration of the liquid refrigerant-oil mixture to the evaporator.

It is desirable to have a solution to reduce the tendency of liquid refrigerant-oil mixture migration to both the condenser and evaporator. It is further desirable for a solution that requires minimal modification of existing components of an air conditioning system.

SUMMARY OF THE INVENTION

An embodiment of the invention provides for an improved internal heat exchanger (IHX) assembly for an automotive system air conditioning system, in which the IHX assembly includes a substantially cylindrical cavity for low pressure refrigerant flow (low pressure side) and an interior tube disposed within the cylindrical elongated cavity for high pressure refrigerant flow (high pressure side). The IHX assembly provides for a pressure equalization passage between the internal tube and the elongated cavity to provide for direct hydraulic communication between the low and high pressure sides. The pressure equalization passage is large enough to allow pressures to equalize between the condenser and evaporator while the air conditioning system is inactive, so as to prevent the pressure differential that would otherwise enable the loss of refrigerant oil from the compressor, and small enough not to affect the operation of the air conditioning system. In other words, the pressure equalization passage allows direct hydraulic communication between the condenser and evaporator, in which vapor refrigerant may migrate directly between the condenser and evaporator while the air conditioning system is in a state of inactivity.

In an alternative embodiment, the pressure equalization passage may be that of a by-pass valve assembly that provides hydraulic communication between the high pressures side and low pressure side of the IHX assembly when the air conditioning system is in a state of inactivity. When the air conditioning system is operating, the by-pass valve assembly closes and seals the low pressure side from the high pressure side for maximum operating efficiency of the air conditioning system.

Further features and advantages of the invention will appear more clearly on a reading of the following detailed description of an embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

This invention will be further described with reference to the accompanying drawings, wherein like numerals indicate corresponding parts throughout the views.

Figure 1:
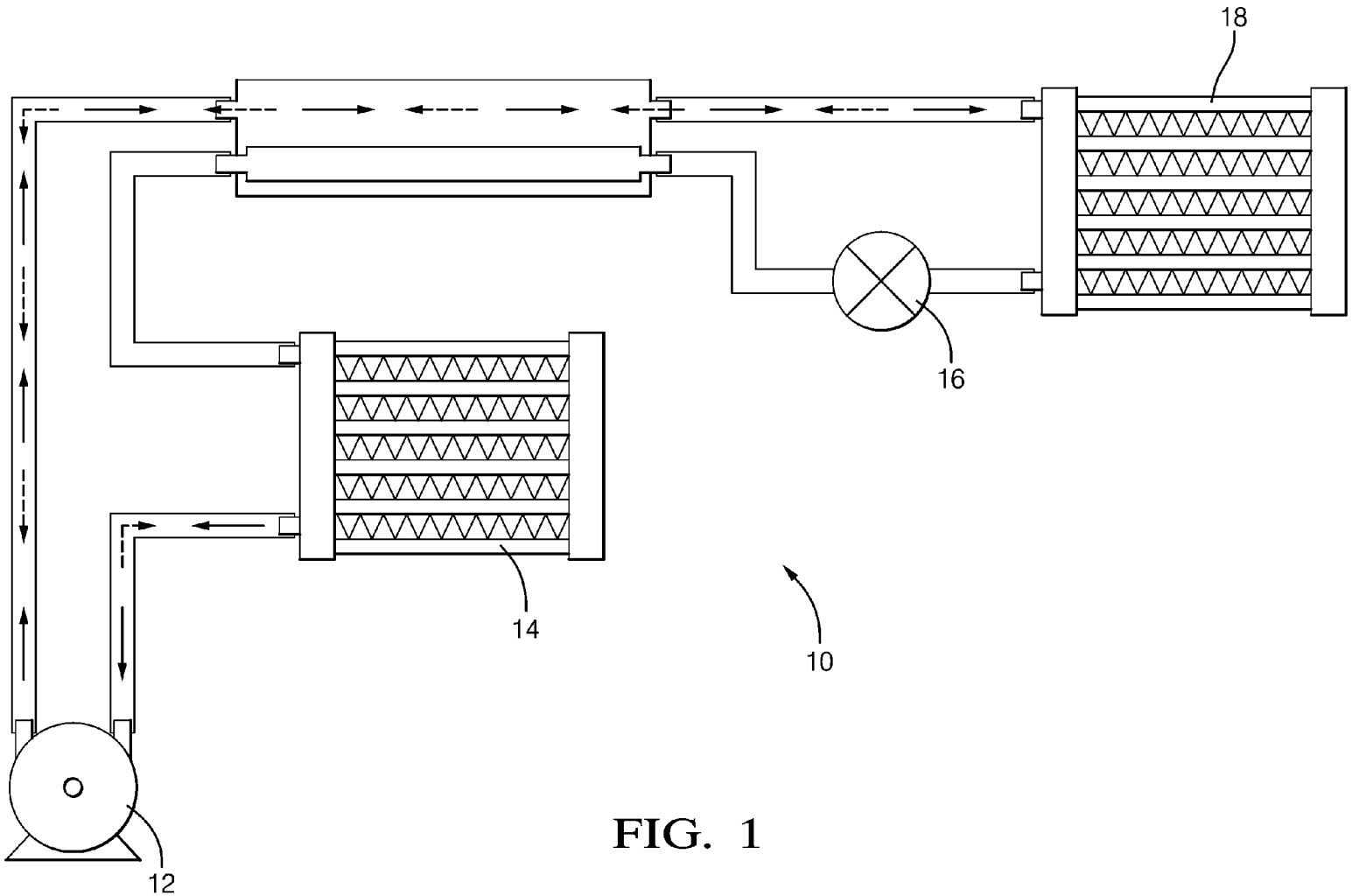
FIG. 1 shows a typical automotive air conditioning system having an IHX assembly.

FIG. 1 shows the migration of refrigerant oil within a typical automotive air conditioning system 10 during extended periods when the air conditioning system 10 and vehicle is in a state of inactivity. Over a period of several days or longer of inactivity, the natural daily thermal cycle causes the vapor refrigerant within the air conditioning system 10 to migrate back and forth through the compressor 12, pushing out small amounts of refrigerant-oil mixture from the compressor 12 and into both the condenser 14 and evaporator 18.

During early morning hours, the condenser 14 is exposed to lower directed, morning sun rays, but more shielded later in the day, and is relatively light weight, so that it both cools and warms relatively rapidly. The evaporator 18 is located typically inside an HVAC housing that is at least partially inside the vehicle cabin, is exposed to the same greenhouse effect of solar warming, and is also capable of relatively rapid warming. The relative location and inherent characteristics of the condenser 14, and evaporator 18, as well as the internal structures of compressor 12, were found to contribute to the previously unappreciated lubricant migration phenomenon noted above.

During the early portion of the day, the sun rays warm and vaporize the liquid refrigerant within the condenser 14. Shown in solid arrows, the increase in vapor pressure forces the vapor refrigerant through the crankcase of the compressor 12 to the evaporator 18 carrying with it the refrigerant-oil mixture from the compressor. During the mid-portion of the day, when the passenger compartment is heated by the greenhouse effect, the liquid refrigerant in the evaporator vaporizes, shown in broken arrows, and pushes the refrigerant-oil mixture from the crankcase into the condenser 14. Over the course of several days, this back and forth washing effect of vapor refrigerant forces the refrigerant-oil mixture out of the compressor 12 and into both the condenser 14 and evaporator 18, leaving the compressor 12 voided of refrigerant oil. The restriction of the thermal expansion valve (TXV) 16 prevents vapor or liquid refrigerant from flowing directly to the evaporator 18 from the condenser 14 or vice versa when the air conditioning system is in a state of inactivity.

In accordance with a preferred embodiment of this invention, referring to FIGS. 2 through 5, is an elegant and cost efficient solution to the problem of refrigerant oil migration during prolonged periods when the air conditioning system is inactive.

Figure 5:
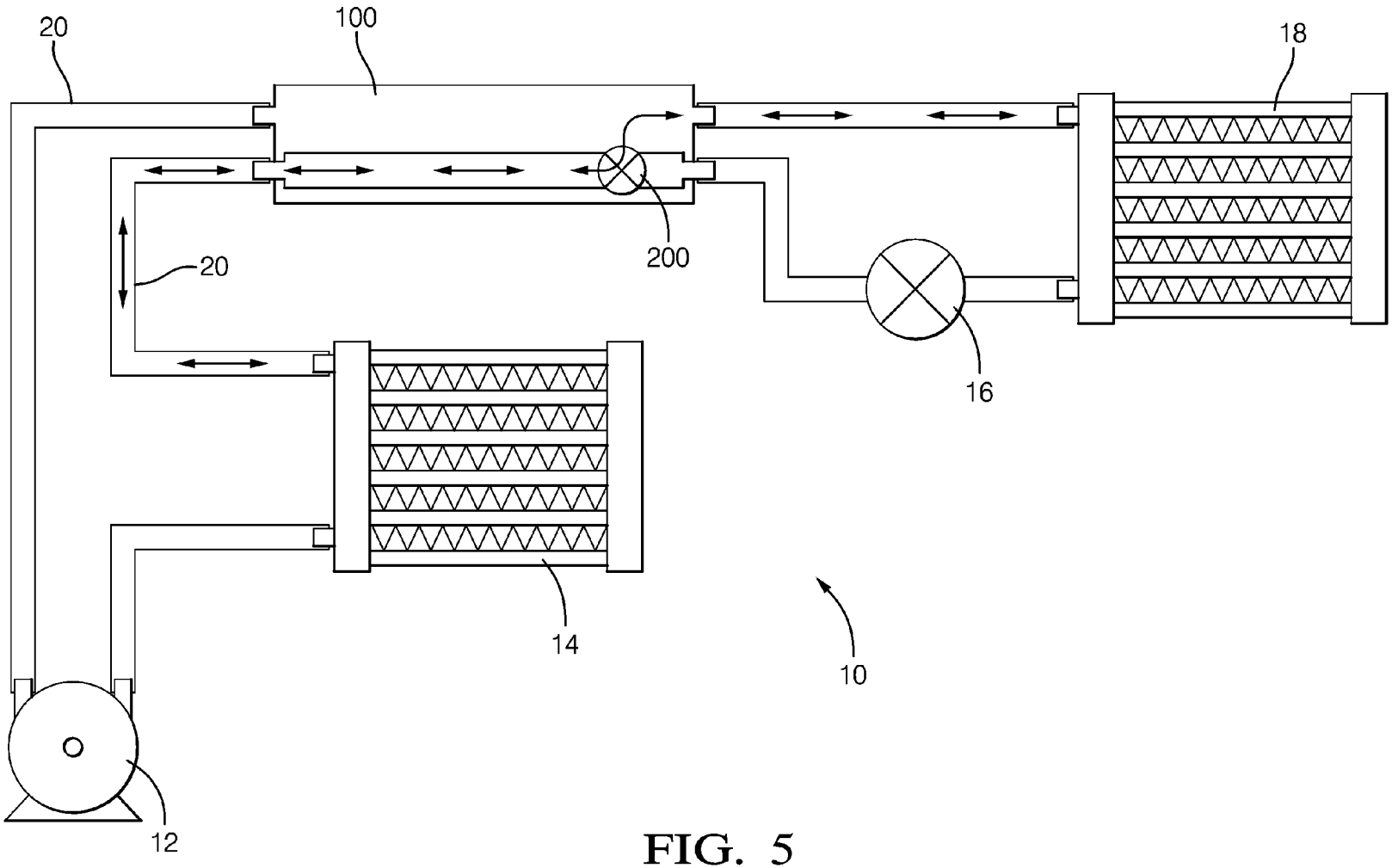
FIG. 5 shows an automotive air conditioning system having an improved IHX assembly that includes a by-pass valve assembly in an open position to mitigate passive refrigerant oil migration.

Shown in FIG. 5 is an automotive air conditioning system 10 that includes a compressor 12, condenser 14, a TXV 16, an evaporator 18, and an improved IHX assembly 100 hydraulically connected by a series of refrigerant tubes 20. The IHX assembly 100 uses the relatively lower temperature and lower pressure refrigerant exiting the evaporator 18 to pre-cool the relatively higher temperature and higher pressure refrigerant exiting the condenser 14 prior to the TXV 16. The flow of low pressure refrigerant from evaporator 18 is counter-current to the flow of high pressure refrigerant from condenser 14 through the IHX assembly 100. An alternative embodiment (not shown) is that the flow of low pressure refrigerant is concurrent with the flow of high pressure refrigerant.

Figure 2:
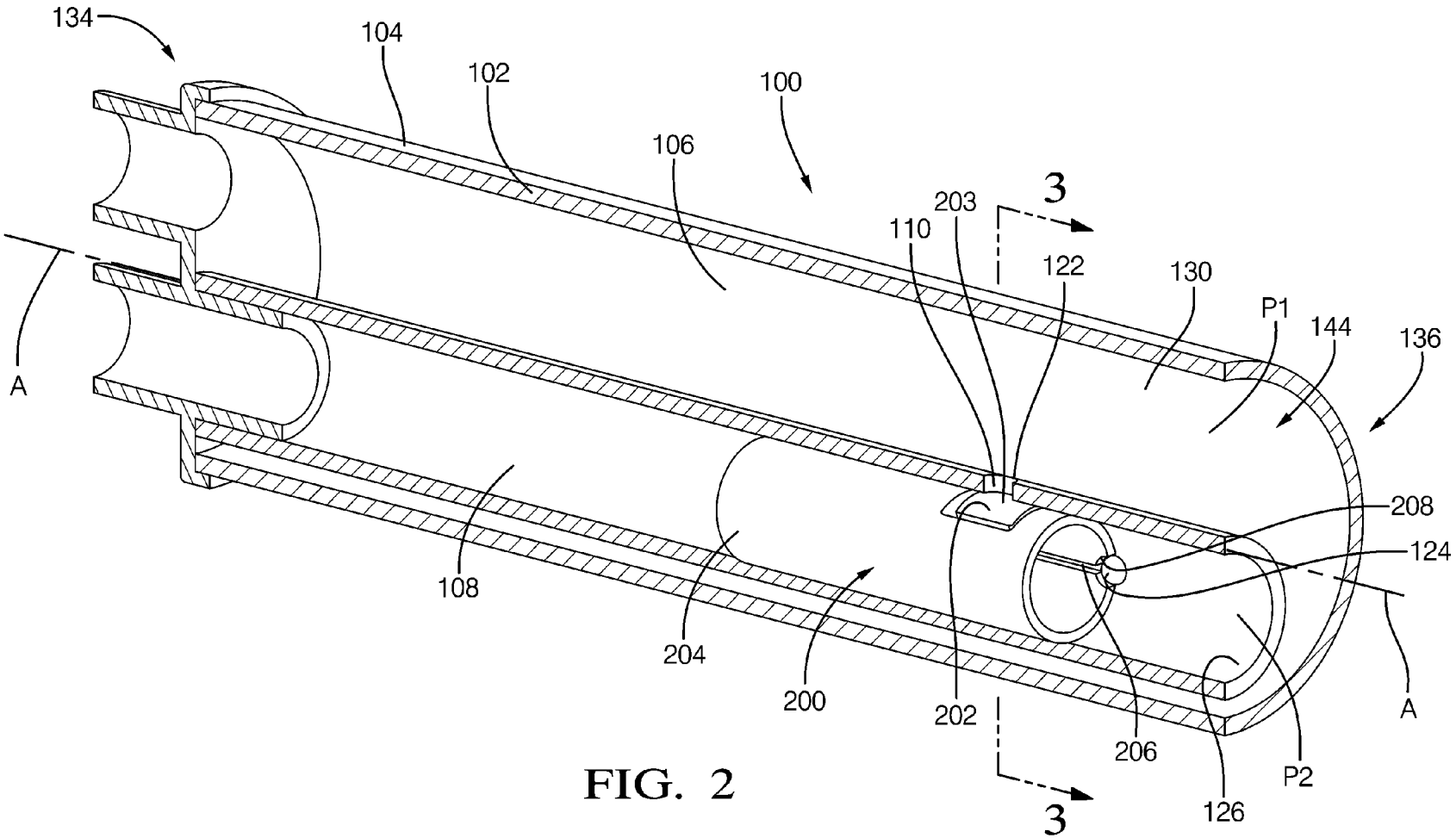
FIG. 2 shows a partial cut-away view of the improved IHX assembly having a by-pass valve assembly.
Figure 3:
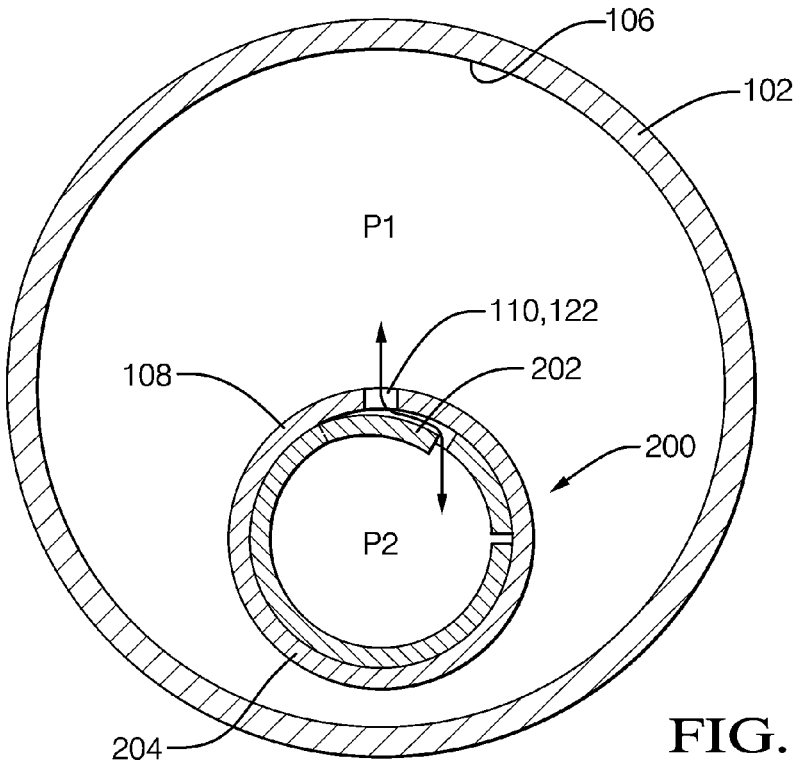
FIG. 3 shows a cross sectional view of the by-pass valve assembly of FIG. 2 in an open position.
Figure 4:
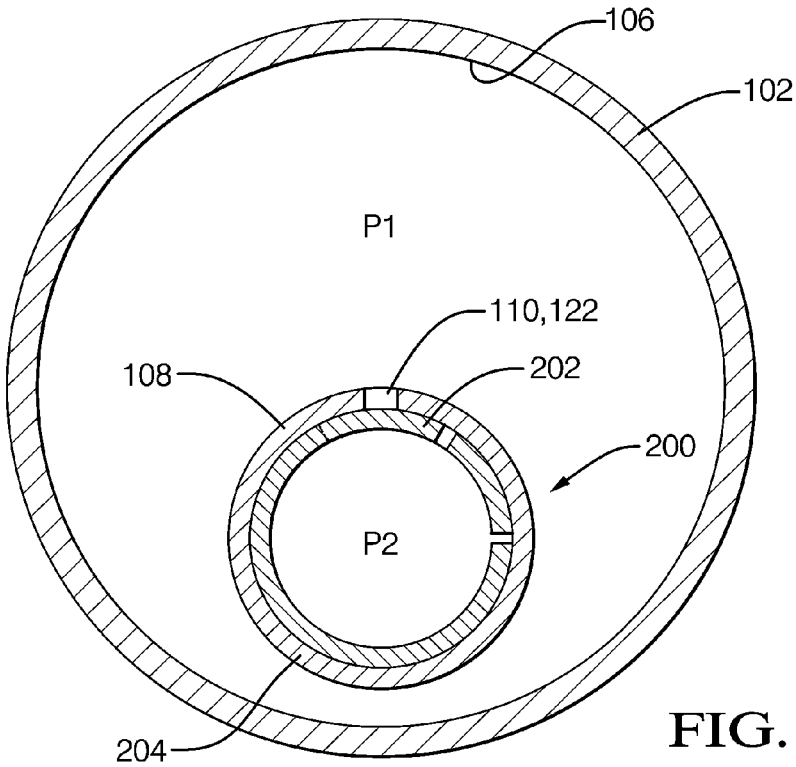
FIG. 4 shows a cross sectional view of the by-pass valve assembly of FIG. 2 in a closed position.

Shown in FIG. 2 is a partial cut-away perspective view of one embodiment, in which the housing 102 of the improved IHX assembly 100 includes an exterior surface 104, an interior surface 106, a first end 134, and a second end 136. The interior surface 106 defines a substantially cylindrical cavity 130 disposed about Axis A. The exterior surface 104 of the housing 102 also has a substantially cylindrical shape; however, the shape of the exterior surface 104 of the housing 102 may be any shape provided that it is capable of accommodating a preferably cylindrical shaped cavity. Disposed within housing 102 is an internal tube 108 extending substantially parallel to Axis A. The internal tube 108 is sized to fit within the cylindrical cavity 130 while providing for a gap 144 between the internal tube 108 and interior surface 106. The gap 144 provides a substantially unobstructed pathway for low pressure refrigerant flow through the cylindrical cavity 130.

The internal tube 108 defines an aperture 122 providing a pressure equalization passage 110 between the internal tube 108 and the elongated cavity 130. The pressure equalization passage 110 is large enough to allow pressures to equalize between the condenser 14 and evaporator 18 while the air conditioning system is inactive, so as to prevent the pressure differential that would otherwise enable the loss of refrigerant-oil mixture from the compressor 12, and small enough not to effect the operation of the air conditioning system. In other words, the pressure equalization passage provides a significant "slow leak" of pressure, but an insignificant "fast leak." During periods of extended inactivity, the pressure equalization passage 110 allows the vapor refrigerant to cycle directly from the evaporator 18 and condenser 14, completely bypassing the compressor 12. Since the refrigerant vapor does not migrate through the compressor 12, the refrigerant-oil mixture is not pushed or pulled out of the crank case of the compressor 12.

Another embodiment of the invention provides for a bypass valve assembly 200 for sealing the pressure equalization passage 110 or aperture 122 when the air conditioning system is in operation and to open the pressure equalization passage 110 or aperture 122 when the system is inactive. The bypass valve assembly 200 enables the aperture 122 to be larger than without the bypass valve assembly 200; thereby, providing faster pressure equalization when the air conditioning system is inactive.

Shown in FIG. 2, the by-pass valve assembly 200 may include a reed portion 202 cooperating with the aperture 122 to provide a reed valve 203. The reed valve 203 would be normally in an open position, in which the pressure equalization passage 110 is unobstructed when the air conditioning system is inactive. The reed portion 202 could be biased away from the aperture 122 when the pressure differential between the high pressure side in the internal tube (P2) and the low pressure side in the elongated cavity (P1) is less than 10 psig, thereby exposing the aperture 122. Shown in FIG. 4, when P2 is much greater than P1, P2 forces the reed portion 202 up against and hermetically seals the aperture 122 to ensure there are no leaks between the high and low side for efficient air conditioning operation. Shown in FIG. 3, when the air conditioning system is inactive, P2 drops significantly relative to P1. As the pressure differential is less than 10 psig, which is a good indicator of system off, the reed portion 202 lifts away from the aperture 122; thereby, allowing the refrigerant vapor pressures between the condenser 14 and evaporator 18 to equalize and by-passes the compressor 12.

The by-pass valve assembly 200 may also include a sleeve 204 having a longitudinal slit 206, which allows the normal diameter (D1) of the sleeve 204 to be compressed and reduced to a smaller diameter (D2) before the sleeve 204 is inserted into the internal tube 108. Once inserted, the sleeve 204 expands to its normal diameter (D1) to create an interference fit within the internal tube 108. The sleeve 204 includes the reed portion 202 such that when the sleeve 204 is positioned correctly within the internal tube, the reed portion 202 is immediately adjacent the aperture 122. Shown in FIG. 3, the reed portion 202 is biased apart from and unseals the aperture when the pressure differential between the high pressure refrigerant and low pressure refrigerant (P2-P1) is equal to or less than 10 psig. Shown in FIG. 4, the reed portion 202 is biased toward and hermetically seals the aperture 122 when the pressure differential between the high pressure refrigerant and low pressure refrigerant (P2-P1) is greater than 10 psig.

To ensure that the sleeve 204 is properly positioned within the internal tube 108 such that the reed portion 202 is immediately adjacent the aperture 122, a protrusion 124 having a predetermined shape may be provided at a predetermined location within the interior wall 126 of the internal tube 108 and a cutout 208 having a complementary shape to that of the protrusion may be provided at one end of the sleeve 204 immediately adjacent to the protrusion, such that the cutout 208 locates and locks onto the protrusion 124. Shown in FIG. 2, the interior wall 126 of the internal tube 108 includes a protrusion 124 having a semi-spherical shape and the sleeve 204 includes a cutout 208 having a complementary semi-circular shape. As the sleeve 204 is inserted into the internal tube (from the left toward the right) during the assembly operation, the cutout 208 cooperates with the protrusion 124 to align and limit the travel of the sleeve 204 within the internal tube 108 such that the reed portion 202 is properly positioned immediately adjacent the aperture 122. The illustration of the semi-spherical protrusion 124 and corresponding complementary shaped cutout 208 is provided for exemplary purposes only and is not intended to be limiting. Those skilled in the art would recognize that any shapes may be utilized provided that the shapes are complementary with each and serves to align and limit the travel of the sleeve 204 relative to the internal tube 108 such that the reed portion 202 is properly positioned immediately adjacent the aperture 122.

An advantage of the internal heat exchanger disclosed herein is that it provides a solution of mitigating refrigerant oil migration to the condenser and evaporator of an air conditioning during prolonged periods of inactivity. Another advantage is that the internal heat exchanger presents an elegant and cost effective solution without adding additional components to the air conditioning system other than a by-pass valve in the internal tube of the IHX assembly.

While this invention has been described in terms of the preferred embodiments thereof, it is not intended to be so limited, but rather only to the extent set forth in the claims that follow.

Having described the invention, it is claimed:

1. An air conditioning system having a compressor cycling a refrigerant through a thermal expansion device, an evaporator, and a condenser, wherein the air conditioning system further includes an internal heat exchanger comprising:

a housing having a first end, a second end opposed to said first end, and an interior surface therebetween defining a cavity for conveying low pressure (P1) refrigerant from the evaporator and to the compressor;

an internal tube disposed within said cavity for conveying high pressure (P2) refrigerant from the condenser to the thermal expansion device; and a pressure equalization passage between said internal tube and said cavity providing direct hydraulic communication between the evaporator and the condenser, wherein said pressure equalization passage is large enough to allow pressures to equalize between the condenser and evaporator while the air conditioning system is inactive, so as to prevent the pressure differential that would otherwise enable the loss of refrigerant oil from the compressor, and small enough not to affect the operation of the air conditioning system while the air conditioning system is active said pressure equalization passage includes a by-pass valve assembly including a sleeve having a reed portion that is biased toward and hermetically seals said equalization passage when the pressure differential between the high pressure refrigerant and low pressure refrigerant (P2-P1) is greater than a predetermined value.

2. An air conditioning system having a compressor cycling a refrigerant through a thermal expansion device, an evaporator, and a condenser, wherein the air conditioning system further includes an internal heat exchanger comprising:

a housing having a first end, a second end opposed to said first end, and an interior surface therebetween defining a cavity for conveying low pressure (P1) refrigerant from the evaporator and to the compressor;

an internal tube disposed within said cavity for conveying high pressure (P2) refrigerant from the condenser to the thermal expansion device, wherein said internal tube defines an aperture for direct hydraulic communication between said high and low pressure refrigerants; and a by-pass valve assembly adapted to seal said aperture at above a predetermined P2-P1 pressure differential, and unseal said aperture at below a predetermined P2-P1 pressure differential wherein said by-pass valve assembly includes a sleeve having a reed portion that is biased toward and hermetically seals said aperture when the pressure differential between the high pressure refrigerant and low pressure refrigerant (P2-P1) is greater than a predetermined value.

3. The air conditioning system of claim 2, wherein said reed portion is biased apart from and unsealing said aperture when the pressure differential between the high pressure refrigerant and low pressure refrigerant (P2-P1) is equal to or less than said predetermined value.

4. The air conditioning system of claim 3, wherein said sleeve includes a longitudinal slit biased toward a first diameter, wherein said longitudinal slit allows said sleeve to be compressed to a smaller second diameter to be inserted into said internal tube.

5. The air conditioning system of claim 4, wherein said internal tube includes an interior wall having a protrusion defining a predetermined shape and said sleeve defines a cutout at one end, wherein said cutout includes a shape that is complementary to said predetermined shape of said protrusion.

6. The air conditioning system of claim 5, wherein said cutout is defined at said one end of said sleeve immediately adjacent to said protrusion.

7. The air conditioning system of claim 6, wherein said protrusion is located at a predetermined location on said interior wall of said internal tube to align and limit the travel of said sleeve relative to said internal tube such that said reed portion is positioned immediately adjacent said aperture.

8. An internal heat exchanger for an air conditioning system, comprising:

a housing having a first end, a second end opposed to said first end, and an internal surface therebetween defining a cavity for conveying a refrigerant having a first pressure (P1), and an internal tube disposed within said cavity for conveying a refrigerant having a second pressure (P2) and defining an aperture for direct hydraulic communication between said P1 and P2, and wherein said internal tube includes a by-pass valve assembly that unseals said aperture below a predetermine pressure differential (P2-P1), thereby equalizing said first pressure (P1) and second pressure (P2) wherein said by pass valve assembly includes a sleeve having a reed portion that is biased towards and hermetically seals said aperture when the pressure differential between the high pressure refrigerant and low pressure refrigerant (P2-P1) is greater than a predetermined value.

9. The internal heat exchanger for an air conditioning system of claim 8, wherein said reed portion is biased apart from and unsealing said pressure equalization passage when the pressure differential between the high pressure refrigerant and low pressure refrigerant (P2-P1) is equal to or less than said predetermined value.

10. The internal heat exchanger for an air conditioning system of claim 9, wherein said sleeve includes a longitudinal slit and biased toward a first diameter, wherein said longitudinal slit allows said sleeve to be compressed to a smaller second diameter.

* * * * *